US009752579B2

(12) United States Patent
Kanemitsu et al.

(10) Patent No.: US 9,752,579 B2
(45) Date of Patent: Sep. 5, 2017

(54) SCROLL MEMBER AND SCROLL-TYPE FLUID MACHINE

(71) Applicant: TAIHO KOGYO CO., LTD., Toyota-shi, Aichi (JP)

(72) Inventors: Hiroshi Kanemitsu, Toyota (JP); Masanori Akizuki, Toyota (JP)

(73) Assignee: TAIHO KOGYO CO., LTD., Toyota-shi, Aichi (JP)

( * ) Notice: Subject to any disclaimer, the term of this patent is extended or adjusted under 35 U.S.C. 154(b) by 0 days.

(21) Appl. No.: 15/025,017

(22) PCT Filed: Sep. 29, 2014

(86) PCT No.: PCT/JP2014/075893
§ 371 (c)(1),
(2) Date: Mar. 25, 2016

(87) PCT Pub. No.: WO2015/046513
PCT Pub. Date: Apr. 2, 2015

(65) Prior Publication Data

US 2016/0238007 A1 Aug. 18, 2016

(30) Foreign Application Priority Data

Sep. 27, 2013 (JP) ..... 2013-201439

(51) Int. Cl.
*F04C 18/02* (2006.01)
*F01C 19/08* (2006.01)
(Continued)

(52) U.S. Cl.
CPC ..... *F04C 18/0292* (2013.01); *F01C 19/005* (2013.01); *F01C 19/08* (2013.01);
(Continued)

(58) Field of Classification Search
CPC ..... F04C 27/005; F04C 18/0215; F04C 18/0284; F04C 18/0292; F04C 2210/22;
(Continued)

(56) References Cited

U.S. PATENT DOCUMENTS 4,802,831 A * 2/1989 Suefuji ..... B29C 45/14 418/152
5,035,589 A 7/1991 Fraser, Jr. et al.
(Continued)

FOREIGN PATENT DOCUMENTS

CN 1459006 A 11/2003
EP 2 264 316 A1 12/2010
(Continued)

OTHER PUBLICATIONS

International Search Report for PCT/JP2014/075893 (2 pages).
(Continued)

*Primary Examiner* — Mark Laurenzi
*Assistant Examiner* — Wesley Harris
(74) *Attorney, Agent, or Firm* — Flynn, Thiel, Boutell & Tanis, P.C.

(57) ABSTRACT

A scroll member includes a base having a panel and a spiral blade provided to extend from the panel toward another scroll member, resin layer L1 formed on the base, and a plurality of grooves C formed on a surface of the resin layer. The plurality of grooves C are formed on the surface of resin layer L1. A cross-section of each groove C has a shape similar to a U-shape or a semicircle in which the width decreases toward the deeper position and the rate of change in width increases toward the bottom. Grooves C are formed by moving an edge of a cutting tool along the original surface of the resin layer, which is originally formed on base L0 by application or the like.

6 Claims, 4 Drawing Sheets

(51) Int. Cl.
*F01C 19/00* (2006.01)
*F04C 27/00* (2006.01)
*F01C 21/10* (2006.01)

(52) U.S. Cl.
CPC ..... *F01C 21/104* (2013.01); *F04C 18/0215* (2013.01); *F04C 18/0284* (2013.01); *F04C 27/005* (2013.01); *F04C 2210/22* (2013.01); *F04C 2230/91* (2013.01); *F05C 2253/20* (2013.01)

(58) Field of Classification Search
CPC .... F04C 2230/91; F01C 19/005; F01C 19/08; F01C 21/104; F05C 2253/20
USPC ..... 418/55.4, 142, 55.2; 277/399
See application file for complete search history.

(56) References Cited

U.S. PATENT DOCUMENTS 6,142,755 A * 11/2000 Shiinoki ..... F04C 27/005 29/888.022
6,783,338 B2 * 8/2004 Moroi ..... F04C 18/0284 418/178
2002/0182093 A1 12/2002 Fujita et al.
2003/0063989 A1 4/2003 Rinella
2003/0111511 A1 6/2003 Kanayama et al.
2008/0181802 A1 7/2008 Taniguchi et al.

FOREIGN PATENT DOCUMENTS

JP 58-091388 A 5/1983
JP 62-051783 A 3/1987
JP 2001-342979 A 12/2001
JP 2002-364560 A 12/2002

OTHER PUBLICATIONS

Chinese Office Action in corresponding application No. 201480052599.1 with English translation, dated Nov. 1, 2016 (15 pages).
Extended European Search Report from corresponding application No. 14849943.7, with a mailing date of Jun. 22, 2017 (7 pages).

* cited by examiner

SCROLL MEMBER AND SCROLL-TYPE FLUID MACHINE

TECHNICAL FIELD

The present invention relates to a technique for improving sealing performance of a fluid machine in which a scroll member is used.

BACKGROUND ART

Fluid machines in which a scroll member having a spiral blade is employed are used in automobile air-conditioners (air conditioning machines) and the like, for example. Scroll compressors used in the automobile air-conditioners compress coolant by rotating one of two scroll members relative to the other, the blades of the two scroll members being engaged with each other. Since the blades and panels of the scroll members move in a state of contact in the scroll compressor, the issue of energy loss caused by so-called sliding friction occurs.

Therefore, some ideas have been introduced to reduce the energy loss caused by the sliding friction. For example, Patent Document 1 describes a scroll compressor that is provided with a fixed scroll member and an orbiting scroll member each having a stepped portion and that is configured such that a projecting end of at least one of the stepped portions of the scroll members has a chamfered portion formed to be lower than an extrapolation line of the upper edge.

CITATION LIST

Patent Documents

Patent Document 1: JP 2002-364560A

SUMMARY OF INVENTION

Technical Problem

However, even if the above-mentioned chamfered portion is provided, there are cases where a large clearance between the members allows fluid to leak and thus the efficiency decreases. Even if the clearance between the members is reduced due to thermal expansion, there are cases where abrasion or scraping between the members occurs.

An object of the present invention is to improve sealing performance and wear resistance of a fluid machine in which a scroll member is used.

Solution to Problem

In order to solve the above-described problems, a scroll member according to an aspect of the present invention includes a base including a panel and a spiral blade provided to extend from the panel toward a second scroll member, a resin layer formed on the base, and a plurality of grooves formed on a surface of the resin layer.

It is preferable that the grooves have a width that is smaller than or equal to a pitch between adjacent grooves of the plurality of grooves.

It is preferable that the grooves are formed in a direction other than a direction along the blade.

It is preferable that the grooves have a spiral shape.

It is preferable that the grooves have a depth that is smaller than a pitch between adjacent grooves of the plurality of grooves.

It is preferable that the grooves are formed so as to be connected to other grooves formed on another surface that is adjacent to the surface on which said grooves are formed.

A scroll-type fluid machine according to an aspect of the present invention includes the scroll member as described above, and the second scroll member that increases or reduces a volume of a space formed by the scroll member and the second scroll member by being engaged with the scroll member and rotating relative to the scroll member.

Advantageous Effects of Invention

With the present invention, it is possible to improve the sealing performance and wear resistance of a fluid machine in which a scroll member is used.

REFERENCE SIGNS LIST

1 . . . Scroll compressor, 10 . . . Reed valve, 2 . . . Housing, 3 . . . Rotating shaft, 3*a* . . . Small-diameter portion, 3*b* . . . Large-diameter portion, 3*c* . . . Crank pin, 4 . . . Movable scroll member, 40*a* . . . Bottom surface, 40*b* . . . End surface, 41*b* . . . Inner lateral surface, 42*b* . . . Outer lateral surface, 4*a* . . . Panel, 4*b* . . . Blade, 4*c* . . . Boss, 5 . . . Fixed scroll member, 5*a* . . . Panel, 5*b* . . . Blade, 5*c* . . . Hole, 6 . . . First bearing, 7 . . . Eccentric bush, 7*a* . . . Inner circumferential surface portion, 7*b* . . . Outer circumferential surface portion, 8 . . . Second bearing, B . . . Ridge portion, C . . . Groove, L0 . . . Base, L1 . . . Resin layer, O1 . . . Axis, O2 . . . Axis, S . . . Original surface, S1 . . . Compression space, S2 . . . Discharge space

DESCRIPTION OF EMBODIMENTS

1. Embodiments 1-1. Structure of Scroll Compressor

Figure 1:
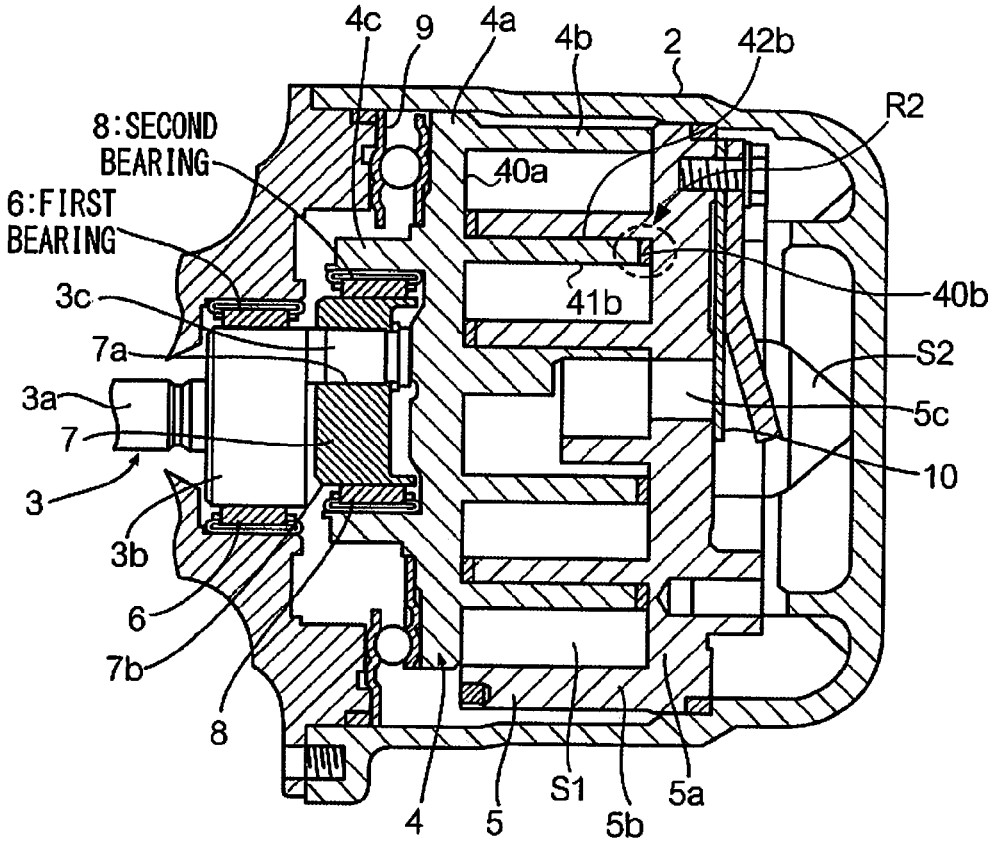
FIG. 1 is a cross-sectional view showing the structure of a scroll compressor according to an embodiment of the present invention.

FIG. 1 is a cross-sectional view showing the structure of scroll compressor 1 according to an embodiment of the present invention. Scroll compressor 1 is a compressor that is applied to an automobile air-conditioner and includes housing 2 fixed to an engine (not shown) of an automobile, rotating shaft 3 provided rotatably in housing 2, movable scroll member 4 rotated with rotating shaft 3, and fixed scroll member 5 fixed inside housing 2. The inside of housing 2 is partitioned into compression space S1 in which movable scroll member 4 and fixed scroll member 5 are located and discharge space S2 that is formed on the right side with respect to fixed scroll member 5 in FIG. 1, and compression space S1 and discharge space S2 are provided with a suction port (not shown) through which a gas such as a coolant is suctioned and a discharge port (not shown) through which the gas such as a coolant is discharged, respectively.

Rotating shaft 3 whose central axis extends in a horizontal direction includes a small-diameter portion 3*a* to which a driving force of the engine is applied, a large-diameter portion 3*b* that is coaxially connected directly to the small-diameter portion 3*a*, and a crank pin 3*c*. The crank pin 3*c*, provided at a position eccentric to rotating shaft 3 including the small-diameter portion 3*a* and large-diameter portion 3*b*, transmits a rotating force to movable scroll member 4. Therefore, when the small-diameter portion 3*a* is driven by the engine, the large-diameter portion 3*b* and small-diameter portion 3*a* coaxially rotate. Accordingly, the crank pin 3*c* revolves at the position eccentric to the small-diameter portion 3*a* and large-diameter portion 3*b*, and movable scroll member 4 revolves with respect to fixed scroll member 5. Here, "revolve" means that a certain member goes around an axis that is located inside another member.

Of these elements, the large-diameter portion 3*b* is supported by a first bearing 6 (i.e., shaft body bearing). That is, first bearing 6 is a ring-shaped member surrounding the large-diameter portion 3*b*. An eccentric bush 7 for transmitting the rotation of rotating shaft 3 to movable scroll member 4 is provided between crank pin 3*c* and movable scroll member 4. This eccentric bush 7 includes an inner circumferential surface portion 7*a* that supports crank pin 3*c*, and an outer circumferential surface portion 7*b* that slides against movable scroll member 4, and the inner circumferential surface portion 7*a* and outer circumferential surface portion 7*b* are provided at positions that are eccentric to each other.

Movable scroll member 4 and fixed scroll member 5 include disk-shaped panels 4*a* and 5*a* that have a predetermined diameter (e.g., 150 mm), respectively, and include blades 4*b* and 5*b* that are provided to extend from panels 4*a* and 5*a* toward panels 5*a* and 4*a* on opposite sides, respectively. In a cross-sectional view taken in a direction orthogonal to the plane of FIG. 1, blades 4*b* and 5*b* form spiral compression space S1. That is, compression space S1 is surrounded by panels 4*a* and 5*a* and blades 4*b* and 5*b*.

A ring-shaped boss 4*c* is formed on a surface of panel 4*a* of movable scroll member 4 on a side opposite to blade 4*b*, and a second bearing 8 (i.e., eccentric shaft bearing) provided on the inner circumferential surface of boss 4*c* rotatably supports crank pin 3*c*. Therefore, when second bearing 8 and movable scroll member 4 integrally revolve around rotating shaft 3, outer circumferential surface portion 7*b* of eccentric bush 7 slides against the inner surface of second bearing 8. Furthermore, a mechanism for preventing the rotation of movable scroll member 4 around an axis that passes through the inside of movable scroll member 4 itself as well as crank pin 3*c* is provided between panel 4*a* of movable scroll member 4 and housing 2. Here, "rotate" means that a certain member rotates around an axis inside said member. Fixed scroll member 5 is fixed to housing 2, and hole 5*c* through which a coolant flows from compression space S1 to discharge space S2 is provided at the center of panel 5*a* and is opened and closed with reed valve 10 having a thin plate-shape.

With scroll compressor 1 having this configuration, when the small-diameter portion 3*a* of rotating shaft 3 rotates with a driving force from the engine, a rotating force acts on movable scroll member 4 through crank pin 3*c* and eccentric bush 7. At this time, since the rotation of movable scroll member 4 is limited, movable scroll member 4 revolves around rotating shaft 3 while maintaining the orientation. Blades 4*b* and 5*b* of movable scroll member 4 and fixed scroll member 5 move relative to each other in compression space S1, and the coolant is suctioned through an inlet formed in housing 2. Subsequently, since the volume of compression space S1 decreases with the rotary motion of movable scroll member 4, the coolant suctioned into compression space S1 is compressed. The compressed coolant moves to the center of compression space S1 due to blades 4*b* and 5*b* moving relative to each other, flows into discharge space S2 through hole 5*c* formed in panel 5*a* of fixed scroll member 5 and through reed valve 10, and then is discharged through the discharge port provided in housing 2.

1-2. Structure of Movable Scroll Member

Movable scroll member 4 includes panel 4*a*, blade 4*b* provided to extend from panel 4*a* toward fixed scroll member 5, and boss 4*c* provided on a surface opposite to blade 4*b*. Of these, panel 4*a* and blade 4*b* come into contact with fixed scroll member 5 described above to form compression space S1. Portions of movable scroll member 4 that come into contact with fixed scroll member 5 are bottom surface 40*a* of panel 4*a* on a side where blade 4*b* is provided, inner lateral surface 41*b* facing the inside of the spiral shape of blade 4*b*, outer lateral surface 42*b* facing the outside of the spiral shape, and end surface 40*b* facing fixed scroll member 5.

End surface 40*b* comes into contact with a portion corresponding to a bottom surface of fixed scroll member 5 described above, and bottom surface 40*a* comes into contact with a portion corresponding to an end surface of fixed scroll member 5. Inner lateral surface 41*b* comes into contact with a portion corresponding to an outer lateral surface of fixed scroll member 5 described above, and outer lateral surface 42*b* comes into contact with a portion corresponding to an inner lateral surface of fixed scroll member 5.

1-3. Resin Layer Provided on Contact Surface of Movable Scroll Member

Figure 2:
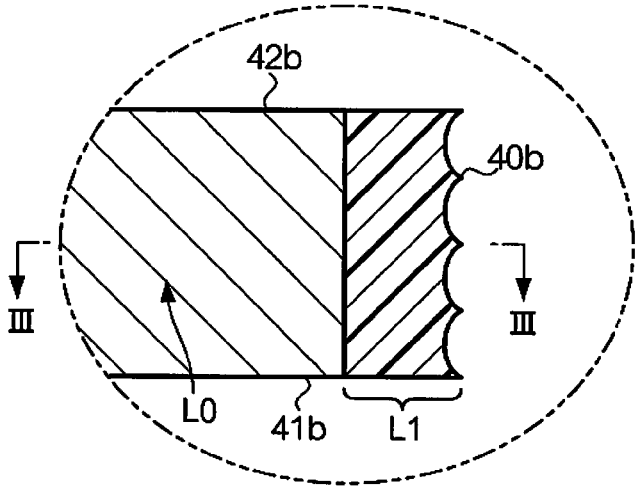
FIG. 2 is a cross-sectional view for illustrating a contact surface of a movable scroll member.

FIG. 2 is a cross-sectional view for illustrating a contact surface of movable scroll member 4. FIG. 2 is an enlarged cross-sectional view of region R2 in FIG. 1. Movable scroll member 4 includes base L0 made of die-cast aluminum, and resin layer L1 provided on base L0. Resin layer L1 contains, as a binder resin, at least one of a polyamide-imide-based resin, a polyimide-based resin, a di-isocyanate-modified polyamide-imide-based resin, a di-isocyanate-modified polyimide-based resin, a BPDA-modified polyamide-imide-based resin, a BPDA-modified polyimide-based resin, a sulfone-modified polyamide-imide-based resin, a sulfone-modified polyimide-based resin, an epoxy resin, a phenol resin, polyamide and elastomer. In addition, resin layer L1 contains, as a solid lubricant, at least one of graphite, carbon, molybdenum disulfide, polytetrafluoroethylene, boron nitride, tungsten disulfide, a fluorine-based resin, and soft metal (e.g., Sn and Bi). It should be noted that base L0 may be made of cast iron or may be made by performing various processes such as sintering, forging, cutting, pressing, and welding on various materials such as aluminum and stainless steel. Base L0 may also be made of ceramic.

Resin layer L1 is formed by applying a coating solution in which the above-described solid lubricant is dispersed in a binder resin and adjusted onto base L0 made of die-cast aluminum. Resin layer L1 may also be formed by a spray method, a roll transfer method, a tumbling method, a dipping method, a brush coating method, a printing method, and the like.

Resin layer L1 is formed on a portion (contact surface) of movable scroll member 4 that comes into contact with fixed scroll member 5. In the example shown in FIG. 2, for example, resin layer L1 is formed on end surface 40*b* of movable scroll member 4.

1-4. Grooves Formed in Resin Layer

Figure 3:
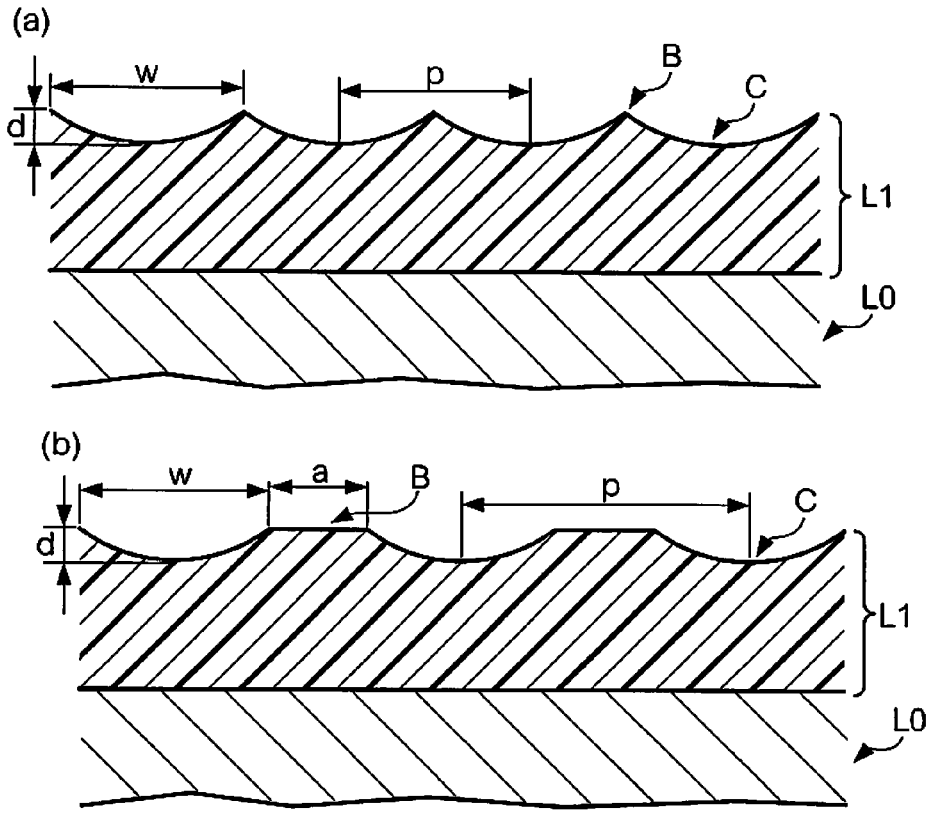
FIG. 3 shows enlarged cross-sectional views of a resin layer in FIG. 2.

A plurality of grooves C are formed on the surface of resin layer L1. FIG. 3 shows enlarged cross-sectional views of resin layer L1 in FIG. 2. As shown in FIG. 3(*a*), a plurality of grooves C are formed on the surface of resin layer L1. A cross-section of each groove C has a shape similar to a U-shape or a semicircle in which the width decreases toward the deeper position and the rate of change in width increases toward the bottom. It should be noted that FIG. 3 shows cross-sections (e.g., surface F6 shown in FIG. 6) orthogonal to a direction in which grooves C extend (a tangential direction of groove C, e.g., a direction indicated by arrow D6 shown in FIG. 6). Cross-sectional views of resin layer L1 shown in FIG. 3 show an outline in order to simplify the description and, compared with actual resin layer L1, resin layer L1 in the diagram is enlarged in the vertical direction.

Grooves C are formed by moving an edge of a cutting tool along the surface of the resin layer originally formed on base L0 by application or the like. Width w of groove C refers to a width of groove C in the cross-section orthogonal to the direction in which groove C extends and corresponds to the length of a segment connecting the two end portions of groove C in the above-mentioned cross-section. Pitch p between grooves C refers to a distance between two adjacent grooves C and corresponds to the length of a segment connecting the centers of these grooves C in the cross-section orthogonal to the direction in which groove C extends. Width a of ridge portion B corresponds to the length of a portion that is located between groove C and another groove C formed adjacent to that groove C and is not cut in the cross-section orthogonal to the direction in which groove C extends.

Width w of groove C is equal to or smaller than pitch p between grooves C ($w \leq p$). In the example shown in FIG. 3(*a*), width w of groove C is equal to pitch p between grooves C. In this case, the original surface of the resin layer is entirely shaved off or remains only at the tip of ridge portion B formed between adjacent grooves C. Since this sharp tip causes a reduction in the area of contact with fixed scroll member 5, a frictional resistance between the scroll members is reduced. Moreover, ridge portion B, which comes into contact with fixed scroll member 5, is likely to be elastically deformed due to its sharp tip, and an oil film is likely to be formed between elastically deformed ridge portion B and fixed scroll member 5, thus improving the sealing performance of the contact portion. In the example shown in FIG. 3(*b*), width w of groove C is smaller than pitch p between grooves C. Ridge portion B is located between grooves C and has a flat tip with width a. In this case, ridge portion B may be formed by being processed or by abrasion. Ridge portion B may also be formed of the original surface layer of the resin layer. It is desirable that width a is smaller than width w ($a<w$). When width a is smaller than width w, groove C is not entirely filled by ridge portion B, which comes into contact with fixed scroll member 5 and elastically deforms. That is, even if ridge portion B is elastically deformed toward grooves C, grooves C hold a lubricant such as oil, and therefore, the sealing performance and wear resistance of scroll compressor 1 are improved.

The locus of the edge of the cutting tool may have a linear shape or a circular arc shape around a certain axis or a spiral shape around an axis. It should be noted that when groove C having a spiral shape is formed, it is sufficient that the distance between the above-described cutting tool and an axis is increased while rotating the cutting tool around the axis. Moreover, pitch p described above is 0.1 to 0.15 mm, for example.

It is desirable that depth d of groove C is smaller than pitch p between adjacent grooves C ($d<p$). In this case, in ridge portion B formed between adjacent grooves C, the width of a base portion corresponding to pitch p is longer than the height corresponding to depth d of groove C, and therefore, ridge portion B is formed into a shape that is relatively sturdy against a force in a lateral direction in FIG. 3. Depth d is 1 to 20 μm, for example.

Since resin layer L1 is formed on base L0 and grooves Care formed on the surface of resin layer L1, movable scroll member 4 need not hold a sealing material, and thus it is unnecessary to provide a holding portion for holding the sealing material.

2. Variations

Although the embodiment has been described above, the contents of this embodiment can be varied as follows. Variations below may be used in combination.

2-1. Member Provided with Resin Layer

Although movable scroll member 4 is provided with resin layer L1 in which grooves C are formed on its surface in the above-described embodiment, fixed scroll member 5 may be provided with resin layer L1. In other words, it is sufficient that resin layer L1 is formed on a base including a panel and a spiral blade provided to extend from the panel toward the other scroll member. However, it is desirable that resin layer L1 in which grooves C are formed is not provided on both of the contact surfaces of movable scroll member 4 and fixed scroll member 5 where the scroll members are in contact with each other, but only on one of the contact surfaces. In particular, in the case where resin layer L1 in which grooves C are formed is provided on one of the contact surfaces of the scroll members, it is desirable that resin layer L1 is not provided on the other contact surface. Moreover, grooves C are not necessarily provided on the entire contact surface, and it is sufficient that grooves C are formed on at least a portion of the contact surface.

2-2. Fluid Machine and Apparatus to which Scroll Member is Applied

Although scroll compressor 1 is applied to an automobile air-conditioner in the above-described embodiment, scroll compressor 1 may also be applied to an air-conditioner for a train, for a house, or for a building, for example, other than an automobile air-conditioner. Moreover, scroll compressor 1 may also be applied to a freezer, a refrigerator, or the like, and may also be used in various apparatuses such as a water temperature adjuster, a constant temperature chamber, a constant humidity chamber, a coating apparatus, a powder transportation apparatus, a food processing apparatus, and an air separation apparatus.

Although movable scroll member 4 is applied to scroll compressor 1 in the above-described embodiment, movable scroll member 4 may be applied to various scroll-type fluid machines such as a blower, an expansion machine, a supercharger, and a power generator. In a case where movable scroll member 4 is applied to an expansion machine, for example, it is sufficient that movable scroll member 4 revolves with respect to fixed scroll member 5 in a direction opposite to the above-described revolving direction. Accordingly, a gas flows into a space surrounded by the scroll members in a direction opposite to the above-described flowing direction, and is expanded and discharged. In other words, the scroll members need only increase and reduce the volume of a space formed by the members being engaged with each other and revolving relative to each other.

2-3. Means for Forming Grooves

Although grooves C are formed by moving the edge of the cutting tool along the surface of the resin layer and shaving the resin layer, a means for forming grooves C is not limited to this. Grooves C may also be formed by etching, a roller, or the like, for example. Moreover, grooves C, each located between adjacent ridge portions B, may also be formed by forming a plurality of ridge portions B on the flat surface of base L0 or resin layer L1 with stereo printing or the like.

2-4. Grooves Formed on Two Adjacent Surfaces

Although resin layer L1 is formed on end surface 40*b* of movable scroll member 4 in the above-described embodiment, resin layers L1 may be formed on a plurality of contact surfaces. Resin layers L1 may also be formed on end surface 40*b* and inner lateral surface 41*b*, for example.

Figure 4:
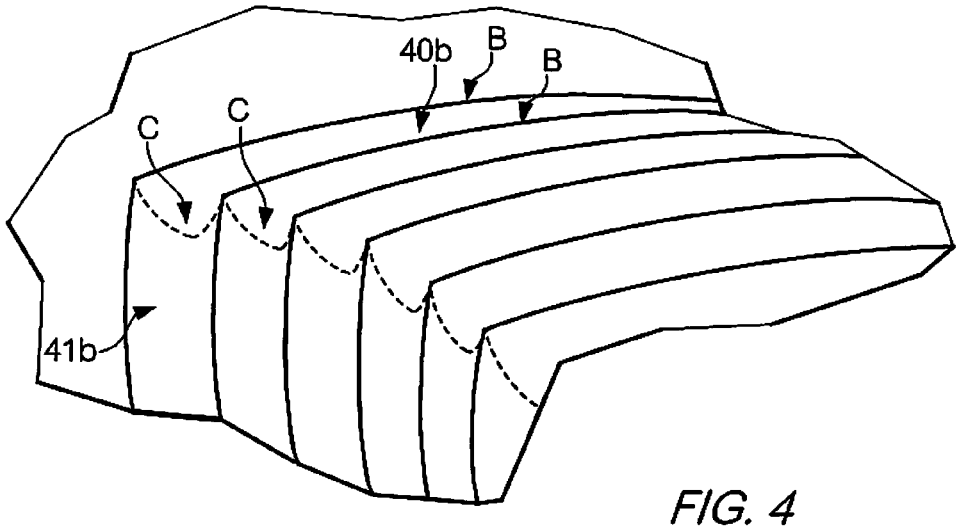
FIG. 4 is a perspective view showing grooves formed on two adjacent surfaces of the movable scroll member.

FIG. 4 is a perspective view showing grooves C formed on the two adjacent surfaces of movable scroll member 4. End surface 40*b* and inner lateral surface 41*b* are adjacent to each other via a ridgeline. Resin layers L1 are provided on end surface 40*b* and inner lateral surface 41*b*, and grooves C are formed on the surfaces of resin layers L1. Grooves C are formed such that grooves C formed on end surface 40*b* and grooves C formed on inner lateral surface 41*b* are connected to each other on the ridgeline between end surface 40*b* and inner lateral surface 41*b*. Accordingly, even if either of end surface 40*b* and inner lateral surface 41*b* comes into intimate contact with a surface of fixed scroll member 5, since grooves C formed on the intimate contact surface are connected to grooves C formed on the other surface, grooves C on the contact surface are likely to hold a lubricant such as an oil.

It should be noted that a processing method for forming grooves C on end surface 40*b* may be different from a processing method for forming grooves C on inner lateral surface 41*b*. In this case, grooves C on end surface 40*b* and grooves C on inner lateral surface 41*b* may be different in at least one of the width, pitch, and depth. That is, not all of grooves C on end surface 40*b* and grooves C on inner lateral surface 41*b* need be connected to each other in a one-to-one relationship, and it is sufficient that some grooves C are connected to each other.

2-5. Direction in which Grooves are Formed

Although the direction in which grooves C are formed is not referred to in the above-described embodiment, it is desirable that the direction in which grooves C are formed is different from the direction along blade 4*b*. Specifically, it is desirable that grooves C are formed in a direction across the ridgelines forming end surface 40*b* of blade 4*b*.

Figure 5:
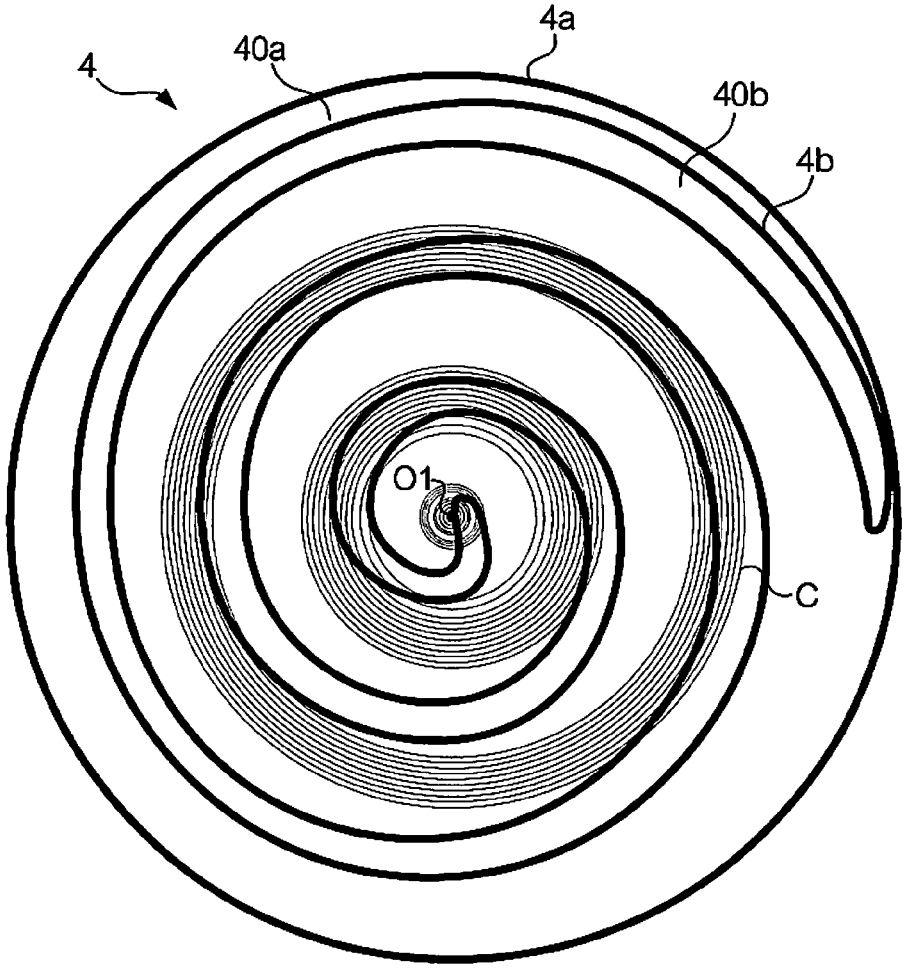
FIG. 5 is a diagram for illustrating a direction in which the grooves are formed in the movable scroll member.

FIG. 5 is a diagram for explaining a direction in which grooves C are formed in movable scroll member 4. Axis O1 is the center of panel 4*a* and is a contact point between blade 4*b* and blade 5*b*. Both blade 4*b* and blade 5*b* are formed along an involute curve defined by a circle around axis O1 such that the involute curve constitutes the center line of the blade. Resin layer L1 shown in FIG. 3 is provided on end surface 40*b* of blade 4*b*, and grooves C are formed on the surface of resin layer L1. Grooves C are formed by rotating the cutting tool around axis O1. It should be noted that although grooves C are drawn as if there are irregular pitches therebetween in FIG. 5 for the sake of convenience of illustrating the diagram, grooves C are actually formed on end surface 40*b* of resin layer L1 at regular pitches without gaps.

In the example shown in FIG. 5, grooves C are concentrically formed around axis O1. Accordingly, grooves C are formed in a direction other than the direction along blade 4*b*. Specifically, grooves C are formed in any direction intersecting the direction along blade 4*b*, that is, in a direction across the ridgelines of blade 4*b*. Therefore, when end surface 40*b* comes into contact with fixed scroll member 5, a lubricant such as an oil easily goes over the above-described ridgelines and flow into grooves C on end surface 40*b* through grooves C on the other surface. Since grooves C formed on end surface 40*b* come into contact with fixed scroll member 5 while holding the lubricant such as an oil, the sealing performance and wear resistance are improved.

Figure 6:
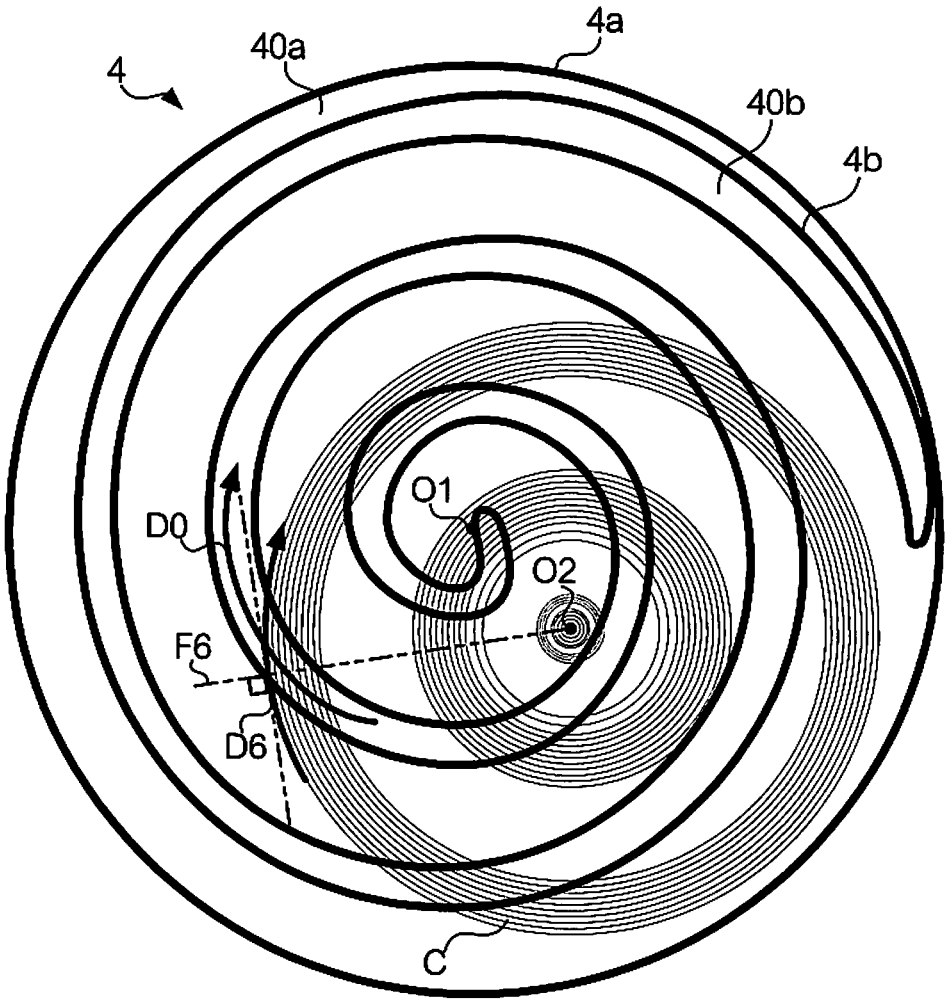
FIG. 6 is a diagram showing grooves formed around an axis that is different from an axis at the center of a panel.

Grooves C may also be formed around an axis other than axis O1. FIG. 6 is a diagram showing grooves C formed by rotating the cutting tool around axis O2 that is different from axis O1, which is the center of panel 4*a*. Also in FIG. 6, grooves C are actually formed on end surface 40*b* of resin layer L1 at regular pitches without gaps. In this manner, even if grooves C are formed around axis O2, which is different from axis O1, it is sufficient that grooves C are formed not in the direction along blade 4*b*, such as a direction indicated by arrow DO shown in FIG. 6, but in a direction that is different from this direction (e.g., a direction indicated by arrow D6 shown in FIG. 6), and that grooves C are formed in a direction that crosses the ridgelines of blade 4*b*.

It should be noted that although grooves C shown in FIGS. 5 and 6 described above are formed on end surface 40*b* of resin layer L1 at regular pitches without gaps, the pitches between grooves C need not be equal, and there may be gaps between adjacent grooves C. Moreover, grooves C may be has a spiral shape around axis O1 or axis O2 as described above.

The invention claimed is:

1. A scroll member arrangement comprising:

first and second scroll members interleaved with each other, the first scroll member comprising a panel and a spiral blade extending from the panel towards the second scroll member;

a resin layer formed on the spiral blade; and a plurality of grooves formed on a surface of the resin layer of said spiral blade, each of the plurality of said grooves having a depth that is smaller than a pitch between two of the plurality of said grooves.

2. The scroll member according to claim 1, wherein the plurality of said grooves have a width that is smaller than or equal to a pitch between adjacent grooves of the plurality of grooves.

3. The scroll member according to claim 1, wherein the plurality of said grooves are formed in a direction other than along the length of the blade.

4. The scroll member according to claim 1, wherein the plurality of said grooves have a spiral shape.

5. The scroll member according to claim 1, wherein the plurality of said grooves are formed so as to be connected to other grooves formed on a surface adjacent to the surface on which the plurality of said grooves are formed.

6. A scroll fluid machine comprising:

a scroll member arrangement comprising:

first and second scroll members interleaved with each other, the first scroll member comprising a panel and a spiral blade extending from the panel towards the second scroll member;

a resin layer formed on the spiral blade; and a plurality of grooves formed on a surface of the resin layer of said spiral blade, each of the plurality of said grooves having a depth that is smaller than a pitch between two of the plurality of said grooves;

wherein the second scroll member increases or reduces a volume of a space formed by the first and second scroll members through engagement with the first scroll member and rotating relative thereto.

* * * * *